United States Patent [19]

Jantzen

[11] 4,353,310

[45] Oct. 12, 1982

[54] CUSHIONED RAILWAY CAR CENTER PLATE ASSEMBLY

[75] Inventor: Steven L. Jantzen, St. Charles, Mo.

[73] Assignee: ACF Industries, Incorporated, New York, N.Y.

[21] Appl. No.: 199,145

[22] Filed: Oct. 22, 1980

[51] Int. Cl.[3] ..... B61F 3/00

[52] U.S. Cl. ..... 105/199 C; 105/413

[58] Field of Search ..... 105/413, 199 R, 199 C, 105/199 CB

[56] References Cited

U.S. PATENT DOCUMENTS

| | | | |
|---|---|---|---|
| 472,854 | 4/1892 | Canada | 105/413 |
| 1,851,486 | 3/1932 | Blackhall et al. | 105/413 |

*Primary Examiner*—Richard A. Bertsch

*Attorney, Agent, or Firm*—Henry W. Cummings

[57] ABSTRACT

In accordance with the invention a center filler assembly is inserted into a railway car center sill and is permanently attached to the center sill. The center filler includes longitudinally spaced vertical plates which extend between the walls of the center sill. Spacer extensions integral with the vertical plates extend beyond the walls of the center sill and abut the bottom surface of the center sill flanges. A mounting plate extends longitudinally of the car between the center filler vertical plates. A mounting extension portion extends downwardly from the mounting plate having a non-round contour adopted to engage a cooperating non-round opening located in a wear member to be located in the truck bowl. Interengaging means are provided to removably lock the wear member in engagement with mounting plate and/or the mounting plate extension. The wear member is preferably an elastomeric member having sufficient vertical compressive strength to carry the vertical loads between the car body and the truck, sufficient lateral compressive strength and sufficient shear strength to carry the horizontal loads between the truck bowl and the car body. In another embodiment the wear member is made of metal. A thin layer of elastomeric material is provided between the mounting plate and the wear member to transmit loads more uniformly between the metal mounting plate and the metal wear member. As an example an elastomeric epoxy coating may be applied to the mounting plate and mounting extension and/or the metal wear member.

15 Claims, 2 Drawing Figures

CUSHIONED RAILWAY CAR CENTER PLATE ASSEMBLY

BACKGROUND OF THE INVENTION

U.S. Pat. No. 3,664,269 discloses a center plate assembly in which a pair of longitudinally spaced plates are welded to the center sill to define a rectangular pocket. A center plate member includes an upper top portion which extends into the pocket and a base portion which is larger than the pocket and rests in the truck bowl. The base portion is welded to the edges of the pocket to form an integral assembly.

However, if the center plate member must be replaced, the welds between the center plate member and the pocket must be burned out. This causes damage to center sill, the spaced plates and to the center plate member.

U.S. Pat. No. 4,174,140 discloses an elastomeric member located between a laterally preshortened car body member and a railway truck bowl. The patent states that the elastomeric member carries both vertical and horizontal loads between the car body and the truck. U.S. Pat. No. 4,213,400 discloses a railway car center plate assembly including a laterally foreshortened car body member and an elastomeric pad bonded to the car body member and to a wear plate located in the truck bowl. However these constructions require a nonstandard, specially formed, laterally foreshortened car body member which is not currently in use in the railway industry.

One object of the present invention is to provide a railway car center plate assembly which does not require modification of the standard car body members or the truck bowl.

Another object of the invention is to provide a railway car center plate assembly including a wear member located in the truck bowl wherein the wear member can be replaced without burning out the center plate member from the center sill.

SUMMARY OF THE INVENTION

In accordance with the invention a center filler assembly is inserted into a railway car center sill and is permanently attached to the center sill. The center filler includes longitudinally spaced vertical plates which extend between the walls of the center sill. Spacer extensions integral with the vertical plates extend beyond the walls of the center sill and abut the bottom surface of the center sill flanges. A mounting plate extends longitudinally of the car between the center filler vertical plates. A mounting extension portion extends downwardly from the mounting plate having a non-round contour adopted to engage a cooperating non-round opening located in a wear member to be located in the truck bowl. Interengaging means are provided to removably lock the wear member in engagement with mounting plate and/or the mounting plate extension.

On either side of the mounting extension, transversely of the center sill the mounting plate is tapered upwardly to abut the center sill vertical walls. The flange portions of the center sill are preferably coped or chamfered to define inclined welding slots.

The center filler also preferably includes a backing plate attached to the upper surface mounting plate. Additional reinforcing means such as a channel may be connected to the backing plate to insure a rugged construction to withstand the coupling impact loads.

A body bolster preferably includes a lower cover plate which abuts and is welded to the flanges on either side of the center sill. In addition, one or more vertical webs of the bolster abut the vertical walls of the center sill and are welded thereto.

The wear member is generally cylindrical to fit within the truck bowl. The lower surface is flat. The wear member includes a center opening having a non-round contour to cooperatively engage the contour of the mounting extension. Interengaging means such as a groove in the mounting extension and a projection formed on the wear member retain the wear member in place on the projections. The upper surface of the wear member is tapered on its sides to correspond to the taper on the mounting plate.

The wear member is preferably an elastomeric member having sufficient vertical compressive strength to carry the vertical loads between the car body and the truck, sufficient lateral compressive strength and sufficient shear strength to carry the horizontal loads between the truck bowl and the car body.

If used in the unlubricated condition an elastomeric wear member tends to increase the speed at which hunting occurs between the truck and car body.

In another embodiment the wear member is made of metal. A thin layer of elastomeric material is provided between the mounting plate and the wear member to transmit loads more uniformly between the metal mounting plate and the metal wear member. As an example an elastomeric epoxy coating may be applied to the mounting plate and mounting extension and/or the metal wear member.

After curing the epoxy coating is firmly attached to the metal wear plate and to the mounting plate and extension and is effective to transmit vertical loads and horizontal loads between the truck and car body.

IN THE DRAWINGS

DESCRIPTION OF PREFERRED EMBODIMENTS

Figure 1:
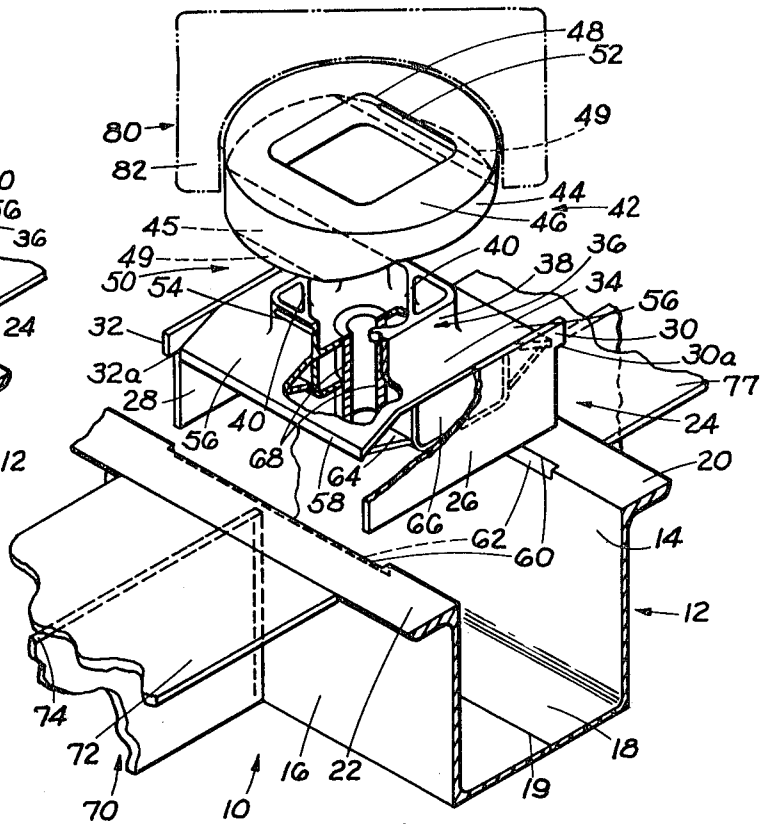
FIG. 1 is a schematic perspective view of the center plate assembly of the present invention rotated 180° to an upstanding position for clarity.

The center plate assembly of the present invention is indicated in the drawings generally at 10. A center sill 12 includes vertical webs 14 and 16 and a horizontal portion 18. In horizontal portion 18 a weld line 19 is provided. Each of the vertical webs 14 and 16 include horizontal flanges 20 and 22.

A center filler 24 includes a pair of longitudinally spaced plates 26 and 28. These plates 26 and 28 are to be inserted within the center sill 12 and welded to web portions 14 and 16.

Plates 26 and 28 each include upper extensions 30 and 32 at each end. These spacer extensions are adopted to engage the center sill flanges 20 and 22 on their lower surfaces **30*a* and 32*a*. The spacer extensions 30*a* and 32*a* are then welded to the respective flanges 20 and 22**.

A mounting plate 34 extends between vertical plates 26 and 28. The mounting plate 34 is generally flat and horizontal in the midportion thereof. A mounting extension portion 36 is located in the midportion of plate 34.

This extension portion is non-round, generally rectangular in FIG. 1, and includes a wall portion 38 extending downwardly. A plurality of ribs 40 reinforce the wall portion. Mounting extension 38 is adopted to receive a wear member indicated generally at 42.

Wear member 42 includes a body portion 44 having a flat lower surface 46, and a non-round opening 48 of a contour to cooperatively engage the non-round contour 38 of projecting portion 36. To insure effective engagement, interengaging means indicated generally at 50 are provided between the wear member 42 and the projecting portion 36. This may comprise a projection 52 located on the wear member 42 and a retaining groove 54 into which the projection 52 fits on the extension 36. Thus it is seen that wear member 42 is rigidly but removably connected to mounting plate extension 36.

Mounting plate 34 is tapered upwardly and outwardly on either side of projecting portion 36 as indicated at 56. Tapered portion 56 terminates in an end portion 58 which is adopted to abut the inner wall of flanges 20 and 22. Flanges 20 and 22 are provided with inclined cuts or chamfers 60 to provide a groove to receive welding material. Thus welds 62 are provided between tapered edges 58 and grooves 60 to integrally connect tapered walls 56 with the flanges 20 and 22 of center sill 12 and also vertical webs 14 and 16.

Center filler 24 further includes an upper support plate 64 which engages either end of tapered portions 56 of plate 34. In addition a reinforcing channel 66 may be provided welded to plate 64 and to plate 34. Thus a strong rugged reinforced construction is provided within the center sill. A king pin support 68 is provided which is welded to plates 34 and 66 to support the conventional king pin.

It thus is to be emphasized that the welds holding vertical plates 26 and 28 within the center sill along the vertical webs 14 and 16 and the welds 62 holding tapered edges 58 in engagement with center sill flanges 20 and 22 and center sill webs 14 and 16 are strong welds. The center filler 24 is thus permanently connected to the center sill. It is not intended that this center filler would be removed once installed.

A bolster 70 includes a flange portion 72 which abuts flange portions 20 and 22 of the center sill and is welded thereto. One or more vertical webs of the bolster 74 are also welded to the vertical webs 14 and 16 of the center sill. Thus the bolster is integrally connected to the center sill.

It will be noted that the wear member 42 includes a tapered portion 49 corresponding to the tapers 56 of plate 34. It will be apparent that tapered portion 49 occurs on either side of the wear member.

The wear member is adopted to be inserted within a conventional truck bowl indicated generally at 80. A truck bowl includes a flange portion 82 which engages the lower portion of the wear plate walls 45.

The wear member is preferably an elastomeric member having considerable strength in compression to withstand the compression loads encountered between the car body and the truck bowl. Furthermore the wear member preferably has sufficient strength in lateral compression to withstand the horizontal loads between the truck and the car body and sufficient strength in shear to resist the tendency for this member to be sheared as horizontal loads are encountered between the truck and the car body. At the same time the elastomeric member should have sufficient resiliency to deform and in so doing cushion loads between the car body and the truck. As is described in U.S. Pat. No. 4,174,140, "the elastomeric pad may be made of any suitable synthetic elastomer which is tough, flexible and stretchable and has good load bearing and wear resistance characteristics."

The elastomeric pad should have a vertical, elastic deflection of about 0.05 to about 0.15 inch under the maximum use load for the center plate assembly; that is, the load limit for which the center plate assembly was designed. The thickness of the elastomeric pad should be such that this deflection does not exceed about 15% of the thickness of the pad. The hardness of the pad should be at least about 40 shore A, as measured by ASTM Method D-2240. The elastomer preferably has a hardness of at least about 80 shore A".

Preferably, the elastomer is a hard polyurethane comprising the reaction product of an organic polyisocyanate, preferably an aromatic polyisocyanate, a polyester polyol or a polyalkyleneether polyol having a molecular weight between about 400 and 3000, and a glycol or an organic polyamine having a molecular weight below about 350. Adiprene L-167 urethane rubber (E.I. du-Pont de Nemours and Company) to give a polyurethane having a hardness of about 48–52 durometer D, as measured by ASTM Method D-2240, is especially preferred. Other suitable synthetic elastomeric materials which have good load bearing qualities include polychloroprene, ethylene/propylene copolymers having one or more nonconjugated dienes, chlorosulfonated polyethylene, styrene-butadiene rubber, and copolymers of butadiene and acrylonitrile. Adiprene L-167 in the nonlubricated condition has been found to be effective in inhibiting hunting over a wide temperature range.

Figure 2:
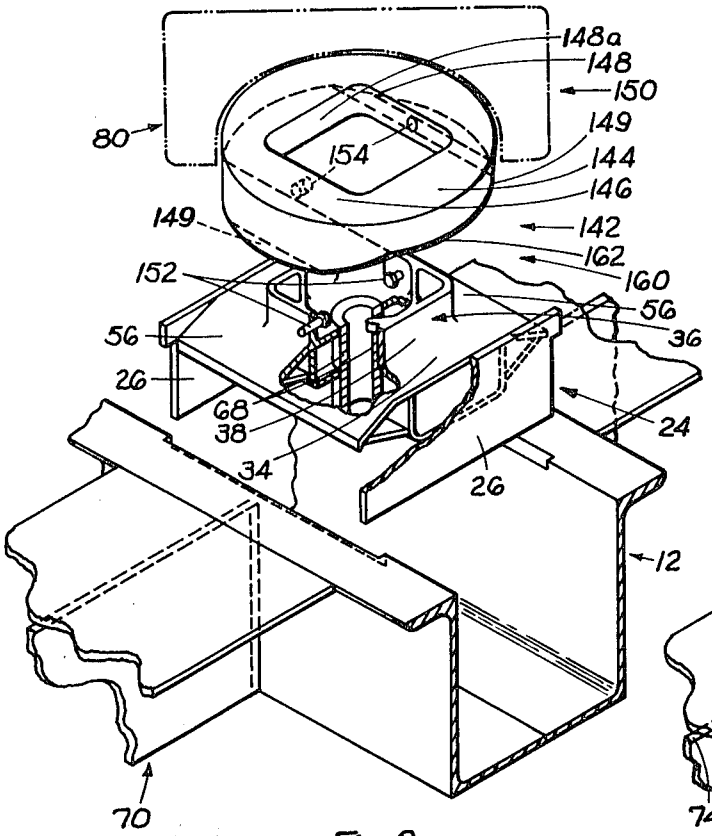
FIG. 2 is a schematic perspective view of an alternative construction of the present invention rotated 180° to an upstanding position for clarity.

In accordance with another embodiment of the present invention illustrated in FIG. 2, a metallic wear member 142 is utilized instead of the elastomeric wear member 42. Metallic wear member 142 includes a cylindrical body portion 144 having a lower flat surface 146 and opening 148 adopted to engage the projection 38. In addition, metallic wear plate is tapered at 149 to correspond to the taper 56 of plate 34. In addition intergating means 150 including a pair of set screws 152 extending through slots 154 are provided. The preferred material for the metallic wear plate is steel, however, aluminum and aluminum alloys of suitable strength may also be utilized.

In this embodiment means 160 are provided to transmit the loads between wear member 142 and plate 34 and projection 36. This means comprises a coating of elastomeric material 162. This coating may be bonded to plate 142 and/or to plate 34 and projection 38. Appropriate bonding technics may reduce the need for interengaging means 150. Coating 162 is conveniently an epoxy coating applied to plate 142 and/or plate 34 and projection 36. The epoxy coating is provided of suitable thickness such that when cured it will cushion, particularly vertical loads, between wear member 142 and plate 34 and projection 38. However, coating 162 will also carry horizontal loads to the extent that the coating is applied between projection 36 and the walls 148*a* of opening 148. This embodiment is otherwise the same as FIG. 1.

In the embodiment in FIG. 1, it is apparent that the elastomeric member is easily replaced when it becomes worn by simply lifting the car body of the truck sufficiently for the operator to effect disengagement between the wear member 42 and the plate 34 and projection 36.

The metal wear plate in FIG. 2 is also readily replaced. Again the car body is raised relative to the truck. Somewhat more effort may be required to disconnect the epoxy which is bonded to the plate 34 and projection 36 than with the mechanical engagement of FIG. 1. After closing plate 34 and projection 38 a new wear plate and a new coat of epoxy may be applied.

However, it is seen that both of these embodiments provide much improved replacement of the wear member as compared to the construction shown in U.S. Pat. No. 3,664,269 wherein the center plate member must be burned out with a flame torch from the pocket in the center sill.

Concerning U.S. Pat. No. 4,174,140 it is apparent that the construction of the present invention utilizes a standard center sill and standard bolster. The non-standard laterally foreshortened car body member is not required in the assembly of the present invention.

What is claimed is:

1. A railway car center plate assembly comprising: a center filler assembly adopted to be inserted into a railway car center sill and permanently attached to the center sill; said center filler including a pair of longitudinally spaced vertical plates which extend between vertical walls of the center sill and which are welded thereto; spacer extensions located below said vertical plates which extend beyond the walls of the center sill and abut the bottom surface of outwardly extending horizontal center sill flanges; a mounting plate extending longitudinally of the center sill between said center filler vertical plates; a mounting extension portion extending downwardly from said mounting plate having a non-round contour adopted to engaged a cooperating non-round opening located in a wear member to be located in the truck bowl; and interengaging means provided on said mounting extension and on said wear member to removably lock the wear member in engagement with said mounting plate and said mounting plate extension.

2. A railway car center plate assembly according to claim 1, wherein on either side of the mounting extension, transversely of the center sill the mounting plate is tapered upwardly to abut said center sill vertical walls.

3. A railway car center filler assembly according to claim 1, including a body bolster including a lower cover plate which abuts and is welded to the flanges on either side of the center sill, and wherein at least one vertical web of the bolster abuts the vertical walls of the center sill and is welded thereto.

4. A railway car center plate assembly according to claim 1, wherein said wear member is generally cylindrical and is dimensioned to fit within the truck bowl and includes a flat lower surface to rest within the truck bowl.

5. A railway car center plate assembly according to claim 4, wherein said interengaging means include a groove in the mounting extension and a projection formed on the wear member retain the wear member in place on the projection.

6. A railway car center plate assembly according to claim 1, wherein said wear member is made of an elastomeric material having sufficient vertical compressive strength to carry the vertical loads between the car body and the truck, sufficient lateral compressive strength and sufficient shear strength to carry the horizontal loads between the truck bowl and the car body.

7. A railway car center plate assembly according to claim 6, wherein said wear member is used in the unlubricated condition and wherein said elastomeric wear member tends to increase the speed at which hunting occurs between the truck and car body.

8. A railway car center plate assembly according to claim 1, wherein said wear member is made of metal.

9. A railway car center plate assembly according to claim 8, wherein a thin layer of elastomeric material is provided between said mounting plate and said wear member to transmit loads more uniformly between the metal mounting plate and said metal wear member.

10. A railway car center plate assembly according to claim 9, wherein an elastomeric epoxy coating is applied to the mounting plate and mounting extension and/or the metal wear member.

11. A railway car center plate assembly according to claim 10, wherein after curing the epoxy coating is firmly attached to said metal wear plate and to said mounting plate and said extension and wherein said coating is effective to transmit vertical loads and at least some horizontal loads between the truck and car body.

12. A railway car center plate assembly comprising: a center filler assembly adopted to be inserted into a railway car center sill and permanently attached to the center sill; said center filler including a pair of longitudinally spaced vertical plates which extend between vertical walls of the center sill and which are welded thereto; spacer extensions located below said vertical plates which extend beyond the walls of the center sill and abut the bottom surface of outwardly extending horizontal center sill flanges; a mounting plate extending longitudinally of the center sill between said center filler vertical plates; a mounting extension portion extending downwardly from said mounting plate having a nonround contour adopted to engage a cooperating nonround opening located in a wear member to be located in the truck bowl; and interengaging means provided on said mounting extension and on said wear member to removably lock the wear member in engagement with said mounting plate and said mounting plate extension; on either side of the mounting extension, transversely of the center sill said mounting plate being tapered upwardly to abut said center sill vertical walls; said flange portions of the center sill being coped or chamfered to define included welding slots adjacent the upper ends of said tapered mounting plate.

13. A railway car center plate assembly according to claim 12, wherein the center filler includes a backing plate attached to the upper surface mounting plate.

14. A railway car center plate assembly according to claim 13, including additional reinforcing means connected to said backing plate to insure a rugged construction to withstand the coupling impact loads.

15. A railway car center plate assembly according to claim 12, wherein the upper surface of the wear member is tapered on its sides to correspond to the taper on the mounting plate.

* * * * *